United States Patent [19]

Cabrera et al.

[11] Patent Number: 4,869,929

[45] Date of Patent: Sep. 26, 1989

[54] PROCESS FOR PREPARING SIC PROTECTIVE FILMS ON METALLIC OR METAL IMPREGNATED SUBSTRATES

[75] Inventors: Alejandro L. Cabrera, Fogelsville; John F. Kirner; Ronald Pierantozzi, both of Orefield, all of Pa.

[73] Assignee: Air Products and Chemicals, Inc., Allentown, Pa.

[21] Appl. No.: 119,119

[22] Filed: Nov. 10, 1987

[51] Int. Cl.[4] ..... C23C 16/24

[52] U.S. Cl. ..... 427/249; 427/255.1; 427/255.2; 427/255.4; 427/255.7; 427/248.1

[58] Field of Search ..... 427/249, 255.1, 255.2, 427/255.4, 255.7, 248.1

[56] References Cited

U.S. PATENT DOCUMENTS

| | | | |
|---|---|---|---|
| 2,665,997 | 1/1954 | Campbell et al. | 427/248.1 |
| 2,665,998 | 1/1954 | Campbell et al. | 427/248.1 |
| 3,554,782 | 1/1971 | Nieberlein | 427/249 |
| 3,902,930 | 9/1975 | Sata et al. | 427/248.1 |
| 4,555,275 | 11/1985 | Tobin | 427/248.1 |
| 4,634,605 | 1/1987 | Wiesmann | 427/249 |
| 4,696,834 | 9/1987 | Varaprath | 427/249 |
| 4,714,632 | 12/1987 | Cabrera et al. | 427/255.1 |

FOREIGN PATENT DOCUMENTS

| | | | |
|---|---|---|---|
| 193998 | 9/1986 | European Pat. Off. | 427/249 |
| 55-3631 | 1/1980 | Japan | 427/249 |
| 57-155365 | 9/1982 | Japan | 427/249 |
| 58-22375 | 2/1983 | Japan | 427/249 |

OTHER PUBLICATIONS

H. C. Hinterman, "Tribological and Protective Coatings by Chemical Vapor Deposition", Thin Solid Films, 84 (1981), 215–243.

F. Bozso et al., "Studies of SIC Formation on Si(100) by Chemical Vapor Deposition", of Appl. Phys. 57(8), p. 2771 (1985).

S. Verspuri, "CVD of Silicon Carbide and Silicon Nitride on Tools for Electrochemical Machine", Proc. Electrochem. Soc. (1979), vol. 79–3.

*Primary Examiner*—Norman Morgenstern
*Assistant Examiner*—Sadie Childs
*Attorney, Agent, or Firm*—Mark L. Rodgers; William F. Marsh; James C. Simmons

[57] ABSTRACT

Silicon carbide protective films are produced on the surface of metallic or metal-impregnated substrates. A silicide or silicon diffusion coating is initially formed on the surface of the substrate, and subsequently said surface is treated with a gas stream which is reducing to the coating and substrate and contains a gaseous carbon source at a temperature greater than 500° C.

19 Claims, No Drawings

PROCESS FOR PREPARING SIC PROTECTIVE FILMS ON METALLIC OR METAL IMPREGNATED SUBSTRATES

TECHNICAL FIELD

The present invention relates to the formation of silicon carbide protective films on the surface of metallic or metal-impregnated substrates.

BACKGROUND OF THE INVENTION

Silicon carbide (SiC) is a well known hard material, with a low coefficient of thermal expansion and inert to a variety of environments such as high temperature oxidation and corrosion by acids. Coatings of dense SiC have been applied to materials such as graphite, silicon or ceramic materials to protect them from oxidation and erosion. The preferred method to produce these coatings is a chemical vapor deposition (CVD) method using methyltrichlorosilane and hydrogen at temperatures between 1000°-1400° C. In this process, the coating is produced primarily by a gas phase reaction. Because of the high temperatures required for this process. It can only be applied to substrates such as graphite, cemented carbide and silicon. While coating of SiC would be very desirable on metallic articles because it would result in good surface properties regarding erosion, corrosion and oxidation as well as good mechanical properties of parts to withstand stress, the high temperatures required would degrade the mechanical properties of the metal. Additionally, when treating metals by this process, there is a problem in the adhesion of the silicon carbide to the metal due to a mismatch in the physical properties between the metal substrate and the SiC ceramic coating and, therefore, the use of metallic interlayers is required.

A second method, glow discharged CVD, is a similar process to CVD but the reaction temperature is lowered by the activation of the gaseous reactants by electrical discharges. Production of SiC coatings on different types of substrates have been obtained by glow discharge activation of silicon halides/hydrocarbon mixtures, such as $SiCl_4$ or $SiH_4$ and $CH_4$ or $C_2H_2$. Although the temperature of the reaction can be lowered to about 300° C. the process must be operated at subatmospheric pressures. In fact, in order to assure a glow discharge in the gas mixture, the reaction chamber remains under partial vacuum during the deposition step. Another disadvantage of this method is the restriction of substrates with simple shapes in order to assure homogenity of the coating.

Several processes have been attempted in the past to apply SiC coatings to various substrates. Japanese patent application, Sho57-155365 entitled "Method for Preparing a Silicon Carbide Coating With Good Adhesion Properties Over a Metal Substrate Surface", teaches the formation of SiC on Ti, Al or 304 stainless steel substrates by glow discharged CVD. The coating is formed in a mixture of $SiH_4/C_2H_2$ in a 1:2 ratio, at a temperature of 300° C. and a total pressure of 0.3 torr.

Japanese patent application Sho58-22375 entitled "Metallic Material Having an Ultrahard Coating and Method for its Manufacturer" teaches the formation of SiC coatings on substrates consisting primarily of carbon-containing iron by a CVD method. The coating is formed from a mixture of methyltrichlorosilane and $H_2$ at 1200° C. and at a pressure of 180 torr. Before applying the SiC coating, the substrate is coated with nickel or cobalt as an intermediate layer.

H. E. Hintermann in an article entitled "Tribological and Protective Coating by Chemical Vapor Deposition", *Thin Solid Films,* 84 (1981) 215-243, teaches the application of refractory coatings for steels and nickel-based alloys. The preferred steels used as substrates are tough hard chromium-containing steels with Mo, V and W added. The preferred method of coating is CVD performed at temperatures between 800°-1000° C. using metal halides.

A paper by F. Bozso, et al. *J. Appl. Phys.* 57(8), p. 2771 (1985) entitled "Studies of SiC Formation on Si(100) by Chemical Vapor Deposition" describes the formation of SiC by the reaction of a single crystal of silicon (Si(100)) and a molecular beam of $C_2H_4$ under ultra high vacuum conditions and at temperatures in excess of 700° C.

An article by G. Verspuri, entitled "CVD of Silicon Carbides and Silicon Nitride on Tools for Electrochemical Machining", Proc. Electrochem. Soc. (1979), Vol. 79-3, describes the formation of SiC on tools made of tungsten and molybdenum by a CVD method at atmospheric pressure using a mixture of dimethyldichlorosilane and $H_2$ at a temperature of 1300° C.

BRIEF SUMMARY OF THE INVENTION

The present invention is a process for producing a SiC protective film on a metallic or metal-impregnated substrate. The process comprises initially forming a silicon diffusion coating on the surface of the metal substrate, or a silicide coating if a metal-impregnated substrate is used. The surface of the substrate is subsequently treated with a gas stream capable of maintaining an atmosphere reducing to the coating during the treatment, and containing a gaseous carbon source at a temperature greater than 500° C.

Typically, the treatment gas stream comprises one or more hydrocarbons as the carbon source, with the balance being $H_2$ or $H_2$/inert gas. The present process is advantageous over prior art coating processes in that it can be carried out at lower temperature; i.e., less than 1000° C., and at atmospheric pressure. This allows the present process to be used for metallic and metal-impregnated substrates which could not be satisfactorily coated using previous methods.

DETAILED DESCRIPTION OF THE INVENTION

The present invention is a process for producing a silicon carbide coating on the surface of metallic or metal-impregnated substrates.

In the process of the present invention, the formation of a SiC coating is a catalyzed surface reaction which can take place at low temperatures (500°-1000° C.) as opposed to traditional CVD which is a gas phase reaction requiring higher temperatures. The process is carried out in two steps, typically at atmospheric pressure, as opposed to CVD which is a single step reaction under vacuum.

For the present process, the formation of an oxide-free Si diffusion coating is required as a first step. The surface silicide is kept under a reducing atmosphere and exposed to small concentrations of a carbon-containing molecules which reacts with the silicide to form SiC. The reaction is surface catalyzed by the metal silicide, and therefore, much lower temperatures are need than with prior techniques, which allows this process to be used on substrates which cannot withstand high temperatures. The silicide surface must be metallic-like to be able to decompose the carbon-containing molecules to provide free carbon for the reaction. A metallic-like surface, as used here, means that it is highly reactive for hydrocarbon decomposition.

The presence of a Si diffusion layer between the metallic substrate and the SiC coating improves adhesion because it alleviates their mismatch in physical properties. For example, a lattice parameter of $\alpha$-Fe is 2.86 Å, while for FeSi it is 4.48 Å, which is much similar to the lattice parameter of cubic $\beta$-SiC which is 4.36 Å. Consequently, there is a better match when growing SiC onto FeSi than onto bare Fe. In addition, the coefficient of thermal expansion of pure Fe or 304 stainless steel is about $12\times10^{-6}$ to $16\times10^{-6}$°C.$^{-1}$ while the coefficient for SiC is between about $3\times10^{-6}$ to $6\times10^{-6}$°C.$^{-1}$ depending on the temperature range. This very large difference can be alleviated with Fe-silicide interlayers for which the expansion coefficient continuously change from $14\times10^{-6}$°C$^{-1}$ for the metal-rich silicide to $6.7\times10^{-6}$°C.$^{-1}$ for the Si-rich silicide.

The process of the present invention is carried out by initially forming a silicide or silicon diffusion coating on the surface of the substrate. This can be accomplished by any known method for forming a Si diffusion coating, such as by the method disclosed in co-pending U.S. patent application Ser. No. 807,890. Typically the substrate is exposed to flowing $SiH_4$ in $H_2$ or $H_2$/inert gas mixtures, where $H_2$ is the carrier gas for $SiH_4$ to assure that the atmosphere remains reducing to the metallic or metal-impregnated surface. While $SiH_4$ is typically used to form the diffusion coating, other Si sources can also be used, for example silicon hydrides such as $Si_2H_6$, halides, etc. The substrate upon which the diffusion coating is formed, is either a metallic substrate or a metal-impregnated substrate. In the case of metallic substrates, a silicon diffusion coating is formed, whereas with metal-impregnated substrates a silicide coating is formed. Typical substrates include Fe, Fe-impregnated carbon composites, Ni, Cr metals and alloys, low carbon steels, chromium steels, stainless steels, Inconel and Incoloy metals. The diffusion coating step is typically carried out in a temperature range of 400°-1000° C., with a preferred range being between 500°-700° C., for a time ranging from one minute to twenty-four hours. Preferably this step is carried out under atmospheric pressure with the silicon source being present in a concentration ranging from several ppm to 5% in $H_2$. It is also important that during this step the atmosphere remains reducing to Si.

Prior to the above described diffusion coating step, it may be desirable to pretreat the substrate to reduce any surface metal oxide which might prevent the reaction of the silicon source; e.g. $SiH_4$ with the metal. This pretreatment can be done by treating the sample in $H_2$ at an oxidant/$H_2$ ratio thermodynamically reducing to the metal at the specific temperature and for a period of time which will allow the reduction rection to go to completion. Oxidant is used here to define any oxygen-containing molecules, such as $H_2O$, $O_2$, $N_2O$, and the like. The pretreatment step is generally carried out in a temperature range between 400°-1200° C. for any period of time sufficient to reduce surface oxides, with at least 0.5 hours being typical. The pretreatment is also preferably carried out at atmospheric pressure although other pressures may be employed.

After a silicide or silicon diffusion coating is formed on the surface of the substrate, it is subsequently treated with a gas stream which is capable of maintaining the atmosphere reducing to the Si coating during treatment, and containing a gaseous carbon source. The gaseous carbon source can be any suitable gas comprising carbon-containing molecules at atmospheric pressure and at treatment temperatures, such as $CH_4$, $C_2H_2$, $C_2H_4$ and the like, present in $H_2$ or mixtures of $H_2$ with $N_2$ and/or other inert gases such as Ar, He, and the like. Treatment with the gaseous carbon source is carried out at 500° C. or greater, typically in a range of 500°-1000° C. and preferably 700°-900° C. for a period of time ranging from one minute to twenty-four hours, and preferably between two minutes and 30 minutes. The treatment is carried out preferably at atmospheric pressure although other pressures between ultra high vacuum to that at which hydrogen embrittlement of the substrate occurs can be employed. The carbon source is present in the treatment gas stream in a concentration ranging from about 10 ppm to 20% and preferably from 1% to 5%, with a tolerable oxidant level being about 100 parts per million or less.

The following examples are presented to illustrate the present invention and are not meant to be limiting.

EXAMPLE 1

Two samples were prepared (samples 1 and 2) to demonstrate the formation of a SiC coating on a pure Fe substrate by the method of the present invention.

Sample No. 1, high purity Fe obtained from Alfa Research Chemicals and Materials having dimensions of 0.4"×0.3"×0.004" was mounted in a conventional surface analysis/deposition system. The sample could be analyzed before and after gas treatment with Auger Electron and X-ray Photoelectron Spectroscopies (AES/XPS), without being removed from the system.

The sample was reduced in $H_2$ with a flow of 400 scc/min, at 800° C. for 0.5 hours. The sample was then siliconized in a mixture of 0.1% $SiH_4$ in $H_2$ at 500° C. for 15 minutes. Without interrupting the $H_2$ flow, the sample was allowed to cool down to room temperature and then the $H_2$ was mixed with ethylene ($C_2H_4$). In a mixture of 4% $C_2H_4$ in $H_2$, the sample was heated at 850° C. for 5 minutes. After this gas treatment, the reactor was evacuated and the sample was inspected by AES under ultra high vacuum conditions. The same procedure was repeated for Sample 2.

SiC was identified on the surface of both Fe samples by its characteristic fingerprint of the silicon and carbon AES spectra. The position of four peaks found in the fine structure of the high energy Si Auger peak are listed in Table 1 below. For comparison, the position of Si peaks for pure Si, $SiO_2$, and SiC are also listed.

TABLE 1

| Sample | $P_1$ | $P_2$ | $P_3$* | $P_4$* | $P_5$* | $P_6$* | $P_7$* |
|---|---|---|---|---|---|---|---|
| 1 | — | — | 1557 | 1573 | 1590 | — | 1616 |
| 2 | — | — | 1561 | 1579 | 1598 | — | 1620 |
| SiC(1) | — | — | 1560 | 1576 | 1596 | — | 1618 |
| Si(2) | 1515 | 1525 | 1543 | 1561 | 1583 | 1601 | 1619 |
| $SiO_2$(2) | — | — | 1547 | 1562 | 1582 | — | 1606 |

*Strongest peaks (1)F. Bozso, et al. J. Vac. Sci. Technol. A2(3) July-Sept. (1984), p. 1271.

(2)"Handbook of Auger Electron Spectroscopy," 2nd Edition (1976) published by Physical Electronic Division, Eden Prarie, Minnesota.

EXAMPLE 2

A third sample of pure Fe was coated with SiC in accordance with the process of the present invention under different conditions from those employed in Example 1.

The pure Fe sample was siliconized in a conventional surface analysis deposition system using 0.1% $SiH_4$ in $H_2$ at 500° C. for 15 minutes. The sample was then reduced at 800° C. in pure $H_2$ for 1 hour, and subsequently heated in a mixture of 5% $C_2H_4$ in $H_2$ at 700° C. for 1 minute.

The sample was analyzed by X-ray diffraction (XRD) and the phases detected were SiC, $Fe_3C$ and graphite. These XRD results confirmed, independently from AES, SiC formation on metallic substrates well below the expected temperature for SiC formation from the thermal gas phase reaction of $SiH_4$ and $C_2H_4$. The thickness of the SiC film in this case was at least 1 μm in order to be detected by XRD.

EXAMPLE 3

Experiments were performed to illustrate that the formation of SiC in accordance with the present invention proceeds via the formation of a metal silicide as an intermediate step and does not occur on non-metallic substrates such as carbon. All the attempts to produce SiC coatings on carbon (C-C) composite substrates using the procedures described in Examples 1 and 2 above were unsuccessful.

Several C-C composite samples obtained from San Fernando Laboratories were cut to dimensions of 0.3"×0.4"×0.002" with a razor blade and mounted in the analysis/deposition system.

Si deposition was accomplished by exposing the C-C composite to a mixture of 0.1% $SiH_4$ in $H_2$ at a temperature of 500° C. for 15 min. AES inspection of the surface revealed the presence of Si but no SiC was detected. The sample was then exposed to 4% $C_2H_4$ in $H_2$ and heated at 850° C. for 5 min. The surface was inexpected again with AES and no SiC was observed. The thickness of the Si coating was about 200 Å as determined by Ar ion sputtering.

EXAMPLE 4

Experiments were performed to demonstrate the formation of SiC from Fe silicide formed on metal-impregnated C-C composite substrates prior to treatment with $C_2H_4/H_2$. A C-C composite sample having dimensions of 0.3"×0.4"×0.004" was impregnated with Fe by dipping the sample in a 1.0 Molar Solution of $Fe(NO_3)_3$ and then air dried and mounted in a surface analysis/deposition system. The sample was then reduced at 800° C. in pure $H_2$ for 0.5 hours and the surface was inspected with AES. The surface was composed of 22% Fe and 78% C, with no oxygen being detected.

The sample was siliconized at 700° C. for 15 min. using 0.1% $SiH_4$ in $H_2$. The surface composition of this sample as well as the composition of samples which were not impregnated with Fe are reported in Table 2 below.

TABLE 2

| Treatment | AES Atomic % Si | C | Fe | Si Penetration (Å) |
|---|---|---|---|---|
| Siliconized 600° C., 15 min. | 7.8 | 92.2 | — | 297 |
| Siliconized 700° C., 15 min. | 9.6 | 90.4 | — | 513 |
| Fe Impregnated/ Siliconized 700° C., 15 min. | 32.1 | 41.1 | 26.8 | >1,620 |

The results reported in Table 2 indicate that the surface of the Fe-impregnated sample was highly enriched in Si as compared with samples which were not impregnated. The Fe-impregnated sample was then sputtered with Ar ions at a rate of 27 Å/min. for 60 min. without reducing the Si and Fe concentrations. XPS analysis of this sample revealed that Si and Fe are present as Fe silicides as determined by their binding energies. The binding energies of these elements for this sample are displayed in Table 3 below.

TABLE 3

| | XPS Binding Energy (eV) Si | C | Fe |
|---|---|---|---|
| Sample | 102.1 | 284.7 | 709.5 |
| FeSi* | 102.3 | — | 710.1 |

*J. Vac. Sci. Technol. A2(2), (1984), p. 441

The sample was then exposed to a mixture of 5% $C_2H_4$ in $H_2$ and heated at 850° C. for 2 min. High resolution AES spectra for Si and C were obtained and the position of the Si peaks were in good agreement with those corresponding to SiC. Nevertheless a carbon peak corresponding to graphitic carbon is also detected, indicating that the SiC coating is not very homogeneous.

EXAMPLE 5

An experiment was performed to demonstrate the formation of a more homogeneous SiC coating on a C-C composite after it has been impregnated with Fe and exposed to longer deposition times. A C-C composite sample was impregnated with 1.0M solution of $Fe(NO_3)_3$, reduced in pure $H_2$ at 800° C. and then siliconized with 0.1% $SiH_4$ in $H_2$ at 700° C. for 0.5 hours. After this step, the sample was removed from the surface analysis/deposition system and was mounted on a new heater. The sample was placed in the system and reduced again at 800° C. for 0.5 hours. $C_2H_4$ was blended with $H_2$ at a concentration of 5% and the temperature was raised to 850° C. for 10 min. The sample was cooled down and inspected with AES. After sputtering the surface with Ar ions for a few minutes, very sharp Si and C Auger lines corresponding to SiC were observed indicating that this coating was more homogeneous than that obtained in Example 4.

Having thus described the present invention, what is now deemed appropriate for Letter Patent is set out in the following appended Claims.

What is claimed is:

1. In a process for producing a SiC protective film on a metallic or metal-impregnated substrate the improvement for forming said protective film without glow discharge activation which comprises:

(a) forming a silicide or silicon diffusion coating on the surface of the substrate; and (b) subsequently treating the surface of the substrate with a gas stream capable of maintaining an atmosphere reducing to the Si coating during treatment, said gas stream comprising $H_2$ or mixtures of $H_2$ with $N_2$, Ar or He and also containing a gaseous carbon source at a temperature greater than 500° C.

2. A process in accordance with claim 1 wherein said gas stream comprises between 10 ppm to 20% gaseous carbon source with the balance inerts and/or $H_2$.

3. A process in accordance with claim 2 wherein said gaseous carbon source comprises one or more gaseous hydrocarbons.

4. A process in accordance with claim 3 wherein said gaseous hydrocarbon is $C_2H_4$ and the balance $H_2$.

5. A process in accordance with claim 1 wherein said treatment is carried out in a temperature range of 700°-900° C.

6. A process in accordance with claim 1 wherein said treatment is carried out at atmospheric pressure.

7. A process in accordance with claim 1 wherein said metal-impregnated substrate is an Fe-impregnated substrate.

8. A process in accordance with claim 1 wherein said substrate is selected from the group consisting of Fe, Fe-impregnated carbon composites, Ni, Cr metals and alloys, low carbon steels, chromium steels, stainless steels, Inconel and Incoloy metals.

9. A process in accordance with claim 1 wherein said silicide or silicon diffusion coating is formed on the surface of the substrate by exposing said substrate to a gas mixture comprising $SiH_4$ and $H_2$ in a temperature range of 400°-1000° C.

10. A process in accordance with claim 9 wherein said substrate is pretreated with a hydrogen containing gas stream to reduce surface metal oxide, prior to forming the diffusion coating.

11. A process in accordance with claim 1 wherein said diffusion coating is formed on the surface of the substrate by a packed cementation process or chemical vapor deposition process.

12. In a process for producing an adherent silicon carbide coating on a metallic or metal-impregnated substrate at atmospheric pressure and at temperatures low enough that will not degrade the mechanical properties of the substrate, the improvement for forming said coating without glow discharge activation which comprises:

(a) forming an oxide-free silicide or silicon diffusion coating on the surface of the substrate; and (b) subsequently treating said substrate, while maintaining conditions reducing to the coating, with a gas stream which is capable of reacting with the silicide or silicon to form a silicon carbide coating, said gas stream comprising $H_2$ or mixtures of $H_2$ with $N_2$, Ar or He and also containing a gaseous carbon source.

13. A process in accordance with claim 12 wherein said carbon-containing gas comprises one or more gaseous hydrocarbons with the balance being inert components and/or $H_2$.

14. A process in accordance with claim 12 wherein said carbon-containing gas contains in a range of 1% to 5% reactive carbon source which is capable of reacting with the silicide or silicon.

15. A process in accordance with claim 12 wherein said treatment of the substrate with a carbon-containing gas is carried out in a temperature range of 500°-1000° C.

16. A process in accordance with claim 15 wherein said treatment is carried out at atmospheric pressure.

17. A process in accordance with claim 12 wherein said substrate is selected from the group consisting of Fe, Fe-impregnated carbon composites, Ni, Cr metals and alloys, low carbon steels, chromium steels, stainless steels, Inconel and Incoloy metals.

18. A process in accordance with claim 12 wherein said silicide or silicon diffusion coating is formed on the surface of the substrate by exposing said substrate to a gas mixture comprising $SiH_4$ and $H_2$ in a temperature range of 400°-1000° C.

19. A process in accordance with claim 12 wherein said diffusion coating is formed on the surface of the substrate by a packed cementation process or chemical vapor deposition process.

* * * * *